United States Patent [19]

Garcia

[11] Patent Number: 4,910,364

[45] Date of Patent: Mar. 20, 1990

[54] FLUX PROOF ROTARY SWITCH

[75] Inventor: Ricardo L. Garcia, Fountain Valley, Calif.

[73] Assignee: Cole Instrument Corp., Santa Ana, Calif.

[21] Appl. No.: 297,591

[22] Filed: Jan. 13, 1989

[51] Int. Cl.[4] ..... H01H 19/58; H01H 21/76

[52] U.S. Cl. ..... 200/11 A; 200/8 R; 200/8 A; 200/11 K; 200/14

[58] Field of Search ..... 200/11 D, 11 G, 11 J, 200/11 K, 11 A, 14, 8 R, 8 A, 564–572

[56] References Cited

U.S. PATENT DOCUMENTS

| | | | |
|---|---|---|---|
| 2,988,606 | 6/1961 | Allison | 200/11 D |
| 3,119,906 | 1/1964 | Mason | 200/11 A |
| 3,144,711 | 8/1964 | Stevens | 200/11 D |
| 3,525,827 | 8/1970 | Allison | 200/11 D |
| 3,571,535 | 3/1971 | Beaver et al. | 200/11 D |
| 3,668,338 | 6/1972 | O'Malley | 200/11 D X |

*Primary Examiner*—J. R. Scott

*Attorney, Agent, or Firm*—Marvin H. Kleinberg

[57] ABSTRACT

A novel rotary switch includes metal contact segments integrally molded into annular plastic frame members which segments are then further sealed to prevent passage of flux or other contaminants from reaching the interior of the switch. Further, each contact segment has an arcuate interior contact portion which engages a rotating bridging member on the inner periphery of the arcuate surface. The arcuate segments are spaced together so that the bridging member that conducts signals to the arcuate surface never contacts a plastic surface. A toothed member is provided to cam the bridging member out of contact with one contact segment before making contact with the next adjacent contact segment.

15 Claims, 3 Drawing Sheets

FLUX PROOF ROTARY SWITCH

BACKGROUND OF THE INVENTION

Discrete rotary switches are a mature technology, and are still the most reliable way to control multi-circuit functions in various voltage and current applications. Such switches are actuated through the rotational action of a shaft. Depending upon the design, the shaft may rotate through a 360 degree range or any portion thereof. Further, the shaft may rotate in either direction (clockwise or counter clockwise) and may be capable of continuous rotation in a chosen direction.

Rotary switches may be of single plane or "deck" construction or may be comprised of a stack of decks which may or may not be similar. Rotary switches come in many sizes, ranging from relatively small for installation on printed circuit boards, to relatively large for panel mounting.

Depending upon the specific application, the rotary switch can be subjected to all types of ambient conditions. Accordingly, rotary switches are constructed in many different ways. Some are designed to merely perform the multi-circuit function with little or no concern for the ambient environment, while others are designed and constructed to protect their operation from many different, often hostile environmental conditions, thereby assuring high reliability and dependability and an extended useful life.

While rotary switches provide a unique multi-circuit function feature, they also provide another major advantage. They are less prone to accidental actuation and can include further safety features such as "pull to turn" or "push to turn" operating modes, as well as latches and locks.

The modern rotary switch is found in commercial, industrial and governmental applications. Military specifications, such as MIL-S-3786, have been promulgated for rotary switches. These impose upon manufacturers certain requirements of standardization and performance for switches that are qualified under such specifications.

Rotary switches of the prior art have generally been made up of modular annular frame members, including frame members which hold a common conducter that is contacted at all times and frame members holding a plurality of conductive segments (the conductive surface areas) which are contacted in a predetermined sequence as a movable contact rotates. The movable contact closes a circuit between the common conductor and the individual conductive segments. These conductive segments incorporate a termination extension of themselves to the exterior of the switch housing, which extensions are terminals to which conductors can be physically and electrically attached.

When the switch is assembled, the frame members are held together by elongated bolts which can compress the frame members into a single assembly. Depending upon the many circuit control configurations available, this type of switch can be utilized to control from one to more than one hundred different circuits.

While acknowledging all of the positive features and advantages of the rotary switch, attention must also be given to those areas of a less positive nature. These include the manner of interconnecting the switch into an application and the ever increasing need to control low level TTL logic signals and so called "dry circuits", which utilize voltage and current signals at extremely low levels.

The normal and customary installation of a switch into a system requires that conductive wires or leads be affixed to the various terminals on the exterior surface of the switch by a soldering process. Unfortunately, the soldering procedures, especially those conforming to government specifications such as WS6536 (a Navy weapons specification) induce a very high temperature at the terminals to initiate the flow of soldering flux over the surface of the affected terminal. Due to the high heat levels, the flux follows the terminal surface and often penetrates the housing, reaching the contact surface on the interior of the switch. The flux, being a non-conductive contaminant, may result in an "open circuit" at best, and may chemically attack the operating components, at worst.

In addition to the concerns of flux contamination, another problem area in prior art rotary switches resides in the mechanism utilized to transport the common conductor to the selected contact point. The nearly universal prior art method employed for moving the conductor from contact point to contact point has been a sliding or "wiping" motion which causes the contact to traverse the plastic material in which the contact points are embedded.

The stated goal of the sliding or wiping contact is to keep the contact points "clean" and free of contaminants such as metal oxides and the like. However, as the conductor slides on the plastic material, it can pick up particles of plastic which are then transferred to the individual contact points and which, in time, become spread over the surface, increasing the contact resistance.

In extreme cases, this contamination can result in an open circuit or in an intermittent fault. Further, the increased resistance can cause arcing which can melt or char the plastic, increasing the contamination. The problem of plastic contamination is especially serious when dealing with low level TTL and/or "dry circuit" applications in which less than five milliohms resistance is a requirement.

SUMMARY OF THE INVENTION

The present invention provides an improved rotary switch which is so constructed as to prevent soldering flux from flowing into the interior of the switch mechanism. This is accomplished by integrally molding the individual contact segments into the body of the frame member. After molding, a vacuum impregnation process seals all interstices with an epoxy compound. Once sealed, there is no opening through which flux can flow. Moreover, the individual contact segments are spaced from the circumferential wall so that the rotating contact member normally will not engage the plastic surface.

Further, the conductive portion of each segment is an arc which extends sufficiently to leave insufficient space for the movable contact to "fall" between adjacent contacts to the supporting, plastic surface. To assist in a "break before make" mode of operation, a circumferential ring is fitted adjacent the frame member containing the plurality of conducting segments with a series of "teeth" which coincide with the "spaces" between successive conductive segments in the frame member. These "teeth" engage the rotating contact member to cam it out of contact with the surface of the segments.

Where there is considerable space between adjacent conductive segments, the toothed rings can keep the rotating member away from the plastic frame member without regard for "make before break" operation. However, even in the absence of the toothed rings, the individual conductive segments will extend sufficiently far from the plastic surface and be spaced close enough together so that the rotating contact member never touches the plastic frame member.

Thus, the object and purpose of the invention is to provide an improved form of rotary switch, and more particularly, a rotary switch which is so constructed as to be essentially free from undesired damage caused either by the flow of soldering flux or cleaning materials into the interior thereof or the contaminating contact between the rotating contacting member and the plastic surface of the frame members in which the individual conductive segments are embedded.

DRAWING SUMMARY

DETAILED DESCRIPTION

Since rotary switches of this general type are very well known in the art it is unnecessary to describe in detail all of the various component parts and how they work. All components are shown, however, in the exploded view of FIG. 9, even though that figure is not described in complete detail.

Figures 1, 2, 3, 8, 9, 10:
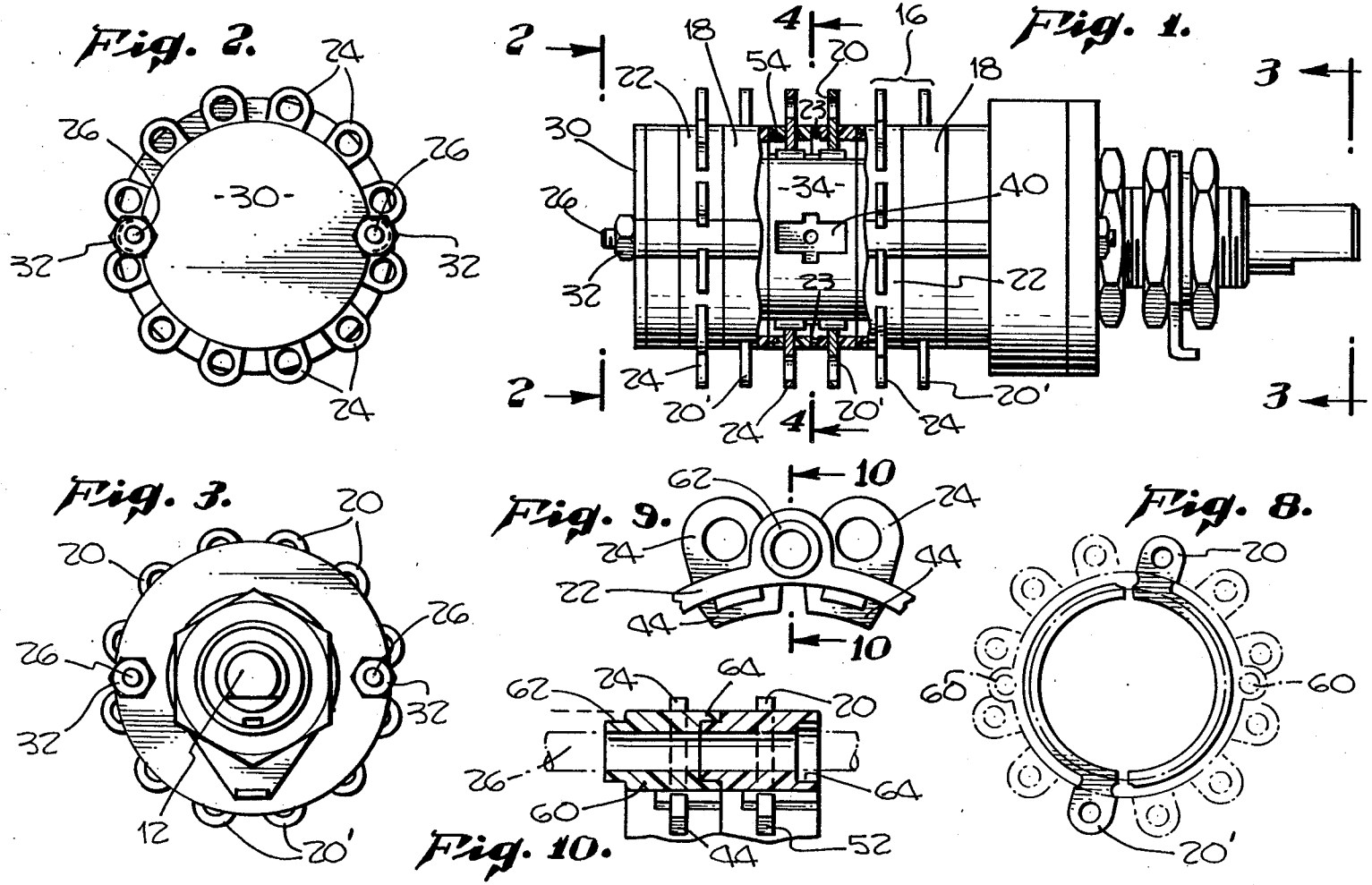
FIG. 1 is an exterior view, partly broken away in cross-section, section, of a rotary switch in accordance with the present invention.
FIG. 2 is an end view of the rotary switch of FIG. 1, taken on Line 2—2 in the direction of the appended arrows.
FIG. 3 is a view of the opposite end of the switch of FIG. 1, taken on Line 3—3 in the direction of the appended arrows showing the operating shaft of the switch.
FIG. 8 is a view of a common contact segment taken along the line 8—8 of FIG. 7 in the direction of the appended arrows.
FIG. 9 is fragmentary view of a portion of a frame member portion, showing the assembling aperture.
FIG. 10 is a sectional view of the portion shown in FIG. 9 taken along the line 10—10 in the direction of the appended arrows.

Turning first to FIG. 1, there is shown a rotary switch 10 according to the present invention. The main shaft 12 and the detent mechanism (shown in FIG. 9) can be of conventional design and need not be further described. The body 14 of the switch 10 is comprised of a plurality of "decks" 16 each of which includes a first frame member 18 having a common terminal 20 and a second frame member 22 with a set of individual contacts 24 which are sequentially connected to the common terminal 20.

As shown, the switch 10 includes three such decks 16. Note that in the illustrated embodiment, the common conductor within the first frame member, is further subdivided into two conductive segments, each with its own terminal 20, 20', This structure can be better understood in connection with the description of FIG. 8, below.

As seen in the partial cutaway section, each of the individual frame members are oriented to have a "groove" 23 in the interior of the periphery on one side to enable them to "stack" with a matching "tongue" 25 on the opposite side, in a preferred orientation. In the illustrated embodiment, a plurality of modular frame members 18, 22 are held together by a pair of long struts 26 which are carried by the switch housing 28 in which the detent apparatus is located. The opposite end of each strut 26 is anchored in an end plate 30. Machine nuts 32 on each threaded end of the struts 26 hold the assembly together and can be tightened to lock all of the elements of the switch 10 together.

The broken away portion of FIG. 1 reveals a contact drum 34 which is rotated by the detent mechanism. Each contact drum 34 includes, on one radial face, a pair of driven pins 36 which fit into a matching pair of driving apertures 38 on an adjacent rotating member. The detent mechanism includes the first pair of driving apertures 38, and each contact drum 34 then drives the adjacent contact drum 34. The contact drum 34, as shown, is designed as a universal element which can carry up to four contacting members, which allows up to four individual terminals 24 of each deck 16 to communicate simultaneously with the common terminal 20.

The contact drum 34 has, for each contacting member, a contact recess 40 in the circumferential surface into which individual roller contacts 42 are placed. The details of the mounting of the roller contacts are better shown and described with reference to FIGS. 4–7 and 11.

FIGS. 2 and 3 show the end plate 30 and the switch housing 28, respectively from end views. As illustrated, the frame member 22 carries, in the particular embodiment, 12 individual segment terminals 24 which are equiangularly arranged at 30° intervals. Obviously, other arrangements are possible with more or fewer segments and at different spacings. The assignee's catalog lists as many as 5 alternatives, ranging from 30° through 90°.

Figure 4:
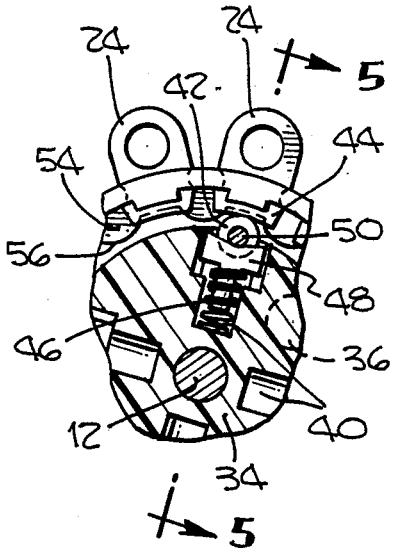
FIG. 4 is a cross-sectional view of a portion of the interior structure of the switch taken on the line 4—4 of FIG. 1 in the direction of the appended arrows.

Turning next to FIGS. 4–7, there is shown, in greater detail, the interaction of the operating elements of the rotating switch 10 according to the present invention. FIG. 4 is a side section showing the roller contact 42 physically and therefore electrically connected to the conductor segment portion 44 of an individual terminal 24. This can also be seen in FIG. 5. A yoke spring 46, located in the bottom of the recess 40 supports a yoke 48 which, in turn, carries the roller contact 42.

The roller contact 42 has a "dumb bell" shape with a narrow, central portion 50 which is engaged by the yoke 48. The yoke spring 46 then biases the roller contact 42 into engagement with both the conductor segment portion 44 of an individual terminal 24 and to the conductor segment portion 52 of the common terminal 20, thereby assuring electrical contact between the common terminal 20 and the individual terminal 24.

Figure 5:
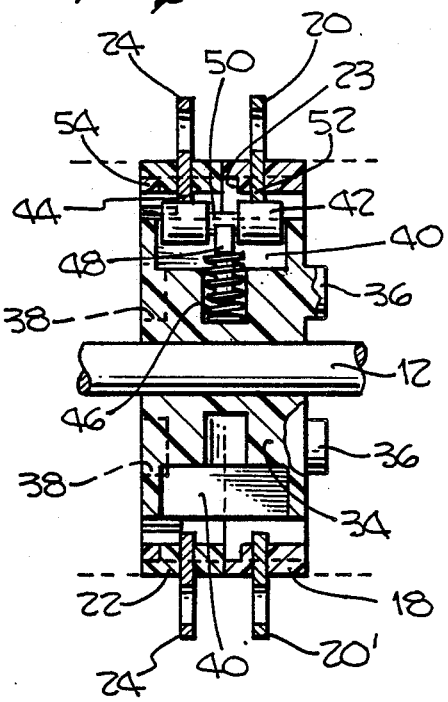
FIG. 5 is a cutaway view of the section partially shown in FIG. 4, taken along line 5—5 in the direction of the appended arrows, showing in detail only one of the rotating contact members illustrated in FIG. 1.
Figure 6:
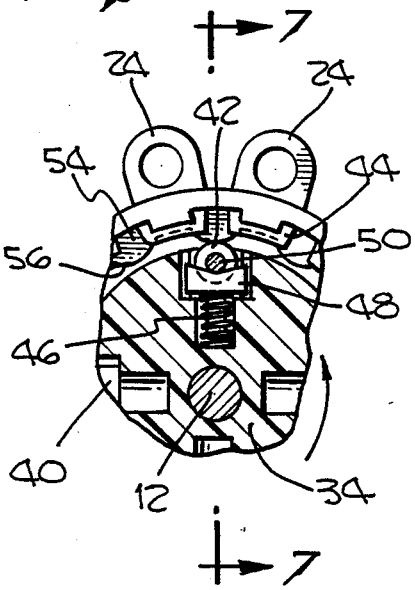
FIG. 6, is a view of the structural segment of FIG. 4, showing the rotating contact member between adjacent conductive segments.
Figure 7:
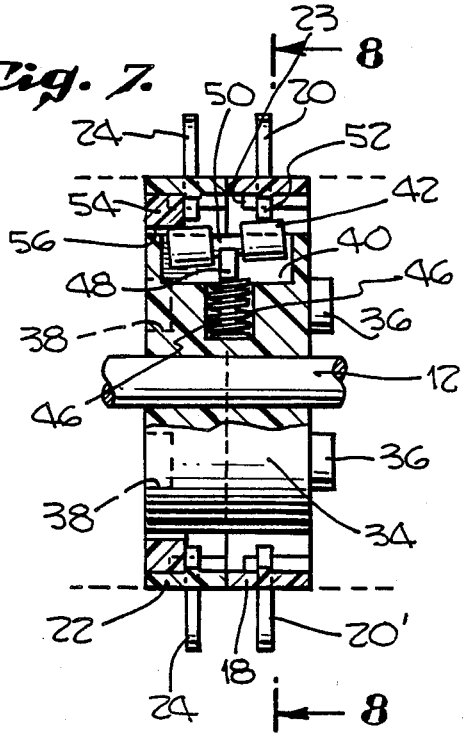
FIG. 7 is view similar to that of FIG. 5, taken along the line 7—7 of FIG. 6 in the direction of the appended arrows.

In FIGS. 4 and 5, the roller contact 42 is shown in engagement with conducting segments 44, 52, while in FIGS. 6 and 7, the roller contact 42 in in contact with a toothed wheel 54, the individual teeth 56 of which are oriented to be between adjacent conductive segments 44 and is positioned adjacent the side opposite the side adjacent the common conductive segment 52. The toothed wheel 54 is made of a nonconductive material which is unlikely to deposit material on the roller contact 42. However, it should be noted that the surface portion of the roller contact 42 which engages the teeth 56 is not the same surface portion which contacts the conductive segments 44, 52, so that even if some plastic is picked up, it will never be deposited upon the conductive surfaces.

As shown, the teeth 56 of the wheel 54 act to tilt or cam the roller contact out of engagement with the conductive segments 44, even though the contact with the common segment 52 may continue. The teeth 56 could also keep the roller contact 42 out of engagement with the plastic surface of the frame 22 if the space between adjacent segments 44 was greater than the diameter of the roller contact 42.

FIG. 8 shows a frame member having a common conductor segment split into two parts, each with its own terminal 20, 20'. There is also shown the assembly apertures 60 through which the struts 26 are fitted when assembling a complete switch. The assembly apertures 60 also include "tongue" and "groove" portions on opposite sides (best seen in FIG. 9) to hold the assembly in alignment before the struts 26 are inserted.

FIGS. 9 and 10 show in greater detail the "tongue and groove" structure of the assembly apertures 60 of the individual frame members 18, 22. In order to prevent relative rotation of the individual frames, each of the apertures 60 has an extending or tongue portion 62 and on the opposite face, a complememtary recess or groove portion 64. This enables the individual frame members to be stacked and aligned in a preferred orientation and maintains the stack in exact alignment when struts 26 are installed and secured to the switch body 14.

Figure 11:
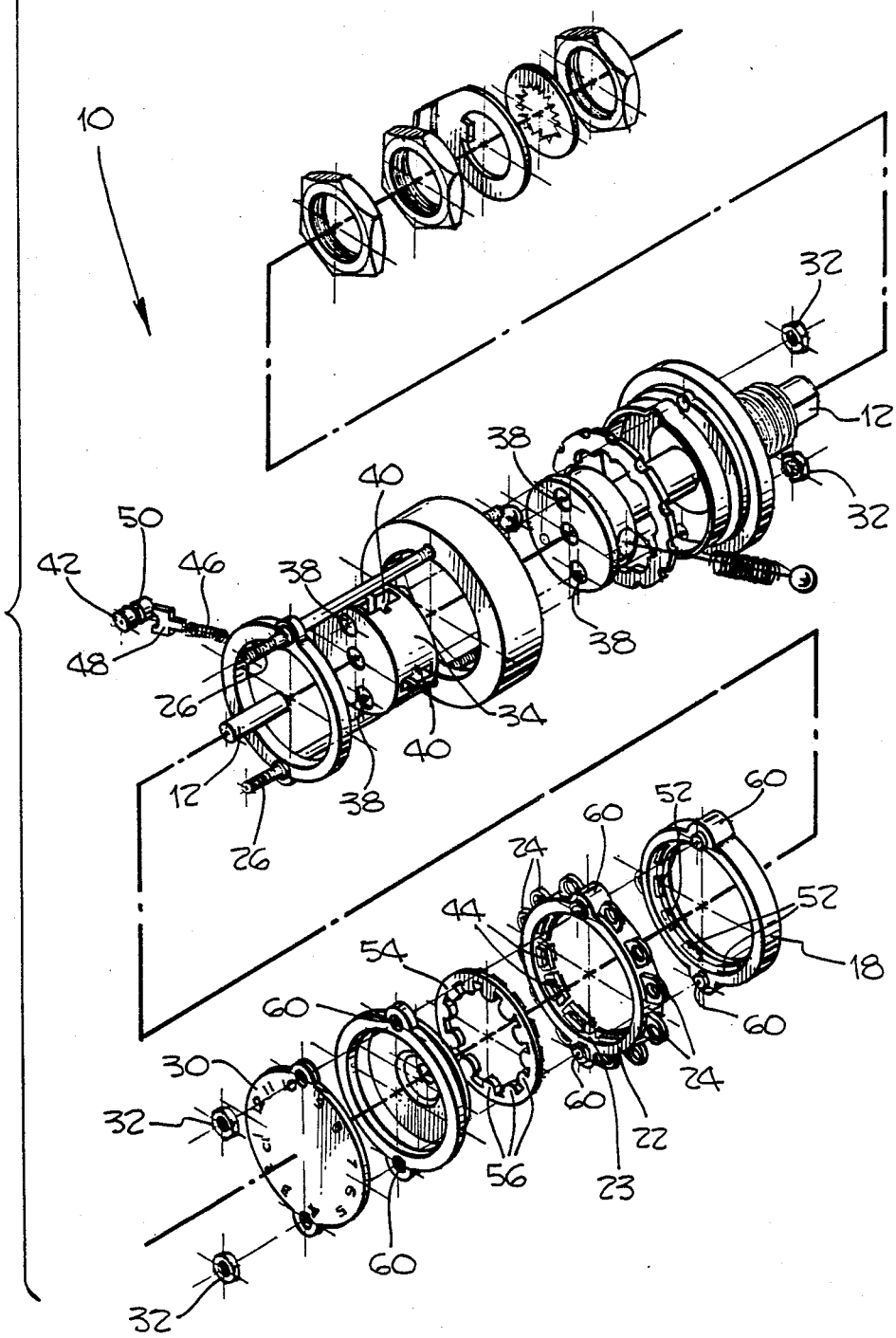
FIG. 11 is an exploded perspective view of an entire switch assembly having a single deck.

Turning finally to FIG. 11, there is shown, in exploded view, a single deck rotary switch according to the present invention. As shown, the individual conductive segments of both the first frame member 18 and the second frame member 22 are integrally molded into the frame. This is accomplished in a two stage manufacturing process in which the segments are first molded into the frame. In a second stage, the frame members are immersed in a liquid epoxy in an evacuatable chamber. As the air is evacuated, the epoxy can be made to flow into any resulting interstices and, when cured, will form a fluid tight bond.

After the rotary switch 10 is assembled, it may be subjected to a further, similar sealing process to prevent any environmental contaminants on the exterior of the switch from penetrating to the interior. These potential contaminants can also include soldering fluxes. Further, because the terminals are sealed into the plastic, the individual terminals can be pre-tinned during the manufacturing process, thereby simplifying the interconnect procedure during which individual conductors are soldered to the various terminals.

Thus there has been shown a novel rotating switch, the interior of which is resistant to exterior surface contamination from fluxes or other potential contaminants and which is also free from contamination of the interior conducting surfaces by plastic which could migrate from the frame structure to the common contact to the conductive surfaces. The switch of the present invention does not utilize the "wiping" or "sliding" contacts of the prior art but rather utilizes a "rolling" contact which, because of substantially "line" engagement, has an extremely high contact pressure which is adequate to break up any surface oxides or other resistivity increasing materials that may form on the conductive surfaces of the segments.

Other improvements or variations may appear to those skilled in the art and, accordingly, the breadth of the invention should be limited only by the scope of the claims attached hereto.

I claim:

1. For use in a rotary switch having a rotating mechanism, a signal deck element comprising:

a. an annular plastic frame member;

b. at least one metal contact segment integrally molded into said annular frame member, said contact segment having a terminal portion extending radially outward from said frame member and a contacting portion including a circumferential, arcuate contacting surface extending radially inward from said frame member;

c. a bridging member coupled to the rotating mechanism having contacting surfaces for engaging the corresponding circumferential contacting surfaces of adjacent frame members;

d. sealing means filling any interstices between said frame member and said segment resulting from the molding process;

e. radially inward extending supports for said contacting portion in a crenellated form extending around the inner periphery of said frame member; and f. a toothed wheel member having a side wall of crenellated form adapted to fit into the crenellations of said frame member, the teeth of said wheel member being positioned adjacent corresponding circumferential contacting surface edges of said contacting portions and being operable to cam said bridging member out of contact with contacting portions adjacent the ends thereof, whereby a bridging member breaks electrical continuity with one contact segment before entering electrical continuity with the next adjacent contact segment, and whereby said arcuate contacting portion is adapted to be in electrical contact with said rotatable bridging member by moving along said contacting member arcuate surface periphery, said bridging member contacting surfaces engaging only contact segments.

2. The deck element of claim 1, above, further including a tinning coating on said terminal portion.

3. The deck element of claim 1, above, further including a least one mounting aperture extending radially outward from said frame member for aligning and securing said frame member to the rotating mechanism.

4. The deck element of claim 1, above, wherein said segments each extend arcuately for substantially a semi circle.

5. The deck element of claim 1, above, further including a third contact segment integrally molded into said annular frame member, said third contact segment having a terminal portion extending radially outward from said frame member and an arcuate contacting portion extending radially inward from said frame member, said arcuate portions having an isolating gap between adjacent edges.

6. The deck element of claim 1, above, further including a plurality of contact segments integrally molded into said annular frame member, said plurality of contact segments each having a terminal portion extending radially outward from said frame member and an arcuate contacting portion extending radially inward from said frame member, said arcuate portions having isolating gaps between adjacent edges.

7. The deck element of claim 1, above, said frame further including radially inward extending supports for said contacting portion in a crenellated form extending around the inner periphery of said frame member.

8. The deck element of claim 1, above, wherein said frame member includes a circumferential relieved portion in the inner side wall of said frame member.

9. The deck element of claim 6, above, said frame further including radially inward extending supports for said contacting portion in a crenellated form extending around the inner periphery of said frame member, and a toothed wheel member having a side wall of crenellated form adapted to fit into the crenellations of said frame member, the teeth of said wheel member being positioned adjacent the adjacent edges of said contacting portions and being operable to cam a bridging member out of contact with adjacent contacting portions at the adjacent ends thereof whereby a bridging member breaks electrical continuity with one contact segment before entering electrical continuity with the next adjacent contact segment.

10. A rotary switch having a main body member and a signal deck comprising:

(a) a first annular plastic frame member;

(b) at least one metal contact segment integrally molded into said annular frame member, said contact segment having a terminal portion extending radially outward from said frame member and a contacting portion having an arcuate, circumferential contact surface extending radially inward from said frame member;

(c) sealing means filling any interstices between said first frame member and said segment resulting from the molding process;

(d) a second annular plastic frame member;

(e) more than one metal contact segment integrally molded into said second annular frame member, each of said contact segments having a terminal portion extending radially outward from said frame member and a contacting portion having an arcuate, circumferential contact surface extending radially inward from said frame member, said second frame member contacting portions having an isolating gap between adjacent portion edges;

(f) sealing means filling any interstices between said second frame member and said segments resulting from the molding process; and g. a rotatable bridging member spanning adjacent frame members having contacting surfaces adapted to engage said circumferential arcuate surfaces of the radially extending contact portions of said contact segments.

11. The rotary switch of claim 10, above, wherein each of said annular frame members include at least one mounting aperture extending radially outward from said frame member for aligning and securing said frame members to the rotary switch body.

12. The rotary switch of claim 10, above, further including a tinning coating on each of said terminal portions.

13. The rotary switch of claim 10, above, wherein each of said annular frame members further include radially inward extending supports for said contacting portions in a crenellated form extending around the inner periphery of said frame members.

14. The rotary switch of claim 13, above, further including a toothed wheel member having a side wall of crenellated form adapted to extend axially into the crenellations of said second frame member, the teeth of said wheel member being positioned adjacent the adjacent edges of said contacting portions and being operable to cam said bridging member out of contact with adjacent contacting portions at the adjacent ends thereof whereby said bridging member breaks electrical continuity with one contact segment before entering electrical continuity with the next adjacent contact segment.

15. The rotary switch of claim 10, above, wherein each of said frame members includes a circumferential relieved portion extending axially into one of the sidewalls thereof.

* * * * *